US008350766B2

(12) United States Patent
Hisaeda

(10) Patent No.: US 8,350,766 B2
(45) Date of Patent: Jan. 8, 2013

(54) ANTENNA-EMBEDDED LAMINATED GLASS

(75) Inventor: Katsumi Hisaeda, Aichi (JP)

(73) Assignee: Asahi Glass Company, Limited, Tokyo (JP)

( * ) Notice: Subject to any disclaimer, the term of this patent is extended or adjusted under 35 U.S.C. 154(b) by 711 days.

(21) Appl. No.: 12/556,047

(22) Filed: Sep. 9, 2009

(65) Prior Publication Data

US 2010/0231466 A1 Sep. 16, 2010

Related U.S. Application Data

(63) Continuation-in-part of application No. 12/114,201, filed on May 2, 2008, now abandoned, which is a continuation of application No. 11/261,509, filed on Oct. 31, 2005, now Pat. No. 7,379,028.

(30) Foreign Application Priority Data

Nov. 1, 2004 (JP) ..... 2004-318022

(51) Int. Cl.
*H01Q 1/32* (2006.01)

(52) U.S. Cl. ..... 343/713; 343/704

(58) Field of Classification Search ..... 343/713, 343/704

See application file for complete search history.

(56) References Cited

U.S. PATENT DOCUMENTS

| | | | | |
|---|---|---|---|---|
| 4,260,989 A | | 4/1981 | Ishii et al. | |
| 4,439,771 A | | 3/1984 | Kume et al. | |
| 4,768,037 A | * | 8/1988 | Inaba et al. | 343/713 |
| 5,095,314 A | * | 3/1992 | Shinnai et al. | 343/713 |
| 5,101,212 A | * | 3/1992 | Shinnai et al. | 343/713 |
| 5,324,374 A | | 6/1994 | Harmand et al. | |
| 5,792,298 A | | 8/1998 | Sauer et al. | |
| 6,191,751 B1 | * | 2/2001 | Johnson | 343/834 |
| 6,452,557 B1 | * | 9/2002 | Twort | 343/713 |

FOREIGN PATENT DOCUMENTS

| | | |
|---|---|---|
| GB | 1 276 057 | 6/1972 |
| JP | 62-72548 | 4/1987 |
| JP | 2-82701 | 3/1990 |
| JP | 6-256044 | 9/1994 |
| JP | 7-149549 | 6/1995 |
| JP | 2001-119219 | 4/2001 |
| JP | 2002-506596 | 2/2002 |
| JP | 2003-136956 | 5/2003 |

OTHER PUBLICATIONS

Office Action issued Feb. 8, 2011, in Japanese Patent Application No. 2005-307878 (with English translation).

* cited by examiner

*Primary Examiner* — Tho G Phan

(74) *Attorney, Agent, or Firm* — Oblon, Spivak, McClelland, Maier & Neustadt, L.L.P.

(57) ABSTRACT

The present invention provides an antenna-embedded laminated glass including glass sheets affixed together through an intermediate film to embed an antenna element between the glass sheets, the intermediate film containing a resin; and the antenna element being configured to have such a shape as to have an intersection where a plurality of antenna-forming strips intersect, and the antenna element comprising a conductor strip stamped in such a shape from a sheet-like conductor.

13 Claims, 8 Drawing Sheets

ANTENNA-EMBEDDED LAMINATED GLASS

CROSS-REFERENCE TO RELATED APPLICATIONS

The present application is a continuation-in-part of U.S. application Ser. No. 12/114,201, filed May 2, 2008, which is a continuation application of U.S. Pat. No. 7,379,028, issued on May 27, 2008. The present application claims a priority under 35 U.S.P. §119 to Japanese Patent Application No. 2004-318022, filed on Nov. 1, 2004. The specifications, the claims, the drawings and the summaries of these applications are incorporated herein by reference in their entirety.

BACKGROUND OF THE INVENTION

1. Field of the Invention

The present invention relates to an antenna-embedded laminated glass with an antenna element sealed between glass sheets.

2. Description of the Related Art

Heretofore, an antenna sheet, which includes a conductive strip for an antenna element and an adhesive layer disposed on a base sheet as disclosed in e.g. JP-A-2001-119219, has been known. This antenna sheet can function as a glass antenna by being bonded to a surface of a glass sheet through the adhesive layer.

Such an antenna sheet is affixed to a surface of a glass sheet in use. From this viewpoint, when such an antenna sheet is bonded to, e.g., an interior surface of the front windshield of a vehicle, the conductive strip needs to be covered with a transparent protective layer. The protective layer is disposed for the purpose of preventing the conductive strip from being damaged and being disconnected by an external force. In some cases, a boundary line between the protective layer and the glass sheet with the antenna sheet affixed thereto is visible since the protective layer has a different refractive index from the glass sheet, and the protective layer covers the glass sheet over a relatively wide area. For these reasons, such an antenna sheet has a problem of poor appearance and a problem of obstructing a driver's view.

On the other hand, in an antenna-embedded laminated glass with an antenna element sealed between glass sheets as disclosed in e.g. JP-A-2-82701, an antenna element is protected by the glass sheets. Even when such an antenna-embedded laminated glass is applied to an automobile windshield, there is no problem, such as a poor appearance caused by the provision of a protective layer in a region except for the provision of the antenna element.

Such an antenna-embedded laminated glass is classified into a print type wherein conductive paste is printed in a desired pattern on an inner surface (mating surface) of a glass sheet to form an antenna element, and an intermediate film embedded type wherein an antenna wire is embedded in an intermediate film (typically made of polyvinyl butyral) interposed between glass sheets.

SUMMARY OF THE INVENTION

The above-mentioned print type cannot solve the problems of a poor appearance or the like since an antenna pattern needs to have a wide line width in order to ensure desired antenna performance because of the presence of large wire resistance.

In this regard, the above-mentioned intermediate film embedded type is advantageous from the viewpoint of appearance or the like since an antenna wire having a small diameter can be embedded in an intermediate film.

Such a glass antenna can be properly tuned so as to receive a desired electromagnetic wave in a target frequency band by comparing various patterns, such as disposing antenna-forming strips in a T-character shape or a cross shape. However, in the above-mentioned intermediate film embedded type with an antenna wire embedded in an intermediate film, when disposing antenna-forming strips are disposed in a T-character pattern or a cross shape, the intersection parts of the antenna-forming strips bank up in comparison with the remaining parts of the antenna-forming strips since the antenna-forming strips are formed of wires or the like.

Laminated glass is produced by interposing an intermediate film between two glass sheets, followed by press-bonding and heat treatment. Such an antenna-embedded laminated glass has had a problem of being defective as a laminated glass since gaps are formed between the intermediate film and parts of the two glass sheets corresponding to the intersections of antenna wires to prevent the intermediate film and the glass sheets from being brought into close contact even in a heat treatment process, such as press-bonding. For this reason, the above-mentioned intermediate film embedded type cannot be formed in such a shape to intersect antenna elements and has a limited tuning performance even if an attempt is made to have an increased antenna sensitivity.

From this point of view, it is an object of the present invention to provide an antenna-embedded laminated glass, which includes antenna elements formed so as to intersect each other.

In order to solve the above-mentioned object, the present invention provides an antenna-embedded laminated glass including a plurality of glass sheets affixed together through an intermediate film to embed an antenna element between adjacent glass sheets, the intermediate film containing a resin; and the antenna element being configured to have such a shape as to have an intersection where a plurality of antenna-forming strips intersect, and the antenna element comprising a conductor strip stamped in such a shape from a sheet-like conductor.

In the present invention, the conductor strip may have a boding strip laminated thereon, and the bonding strip may be affixed to a surface of at least one of the glass sheets that confronts the intermediate film. The bonding strip may be affixed to a convex side of the at least one of the glass sheets.

The conductor strip may have a boding strip laminated thereon, and the bonding strip may be affixed to a surface of the intermediate film.

The conductive strip may have a dark strip laminated on a surface thereof opposite from the bonding strip.

The antenna-embedded laminated glass may include an electrode for taking out a signal, disposed on an outermost glass sheet among the glass sheets; and the antenna element may be coupled to the electrode through static capacitive coupling.

In accordance with the present invention, by stamping a sheet-like conductor to form a conductor strip forming an antenna element, it is possible to provide a laminated glass wherein the antenna element is formed in such a pattern shape that antenna-forming strips intersect in a T-character shape or a cross shape.

DETAILED DESCRIPTION OF THE PREFERRED EMBODIMENTS

Now, preferred embodiments of the present invention will be described, referring to the accompanying drawings.

Figure 1:
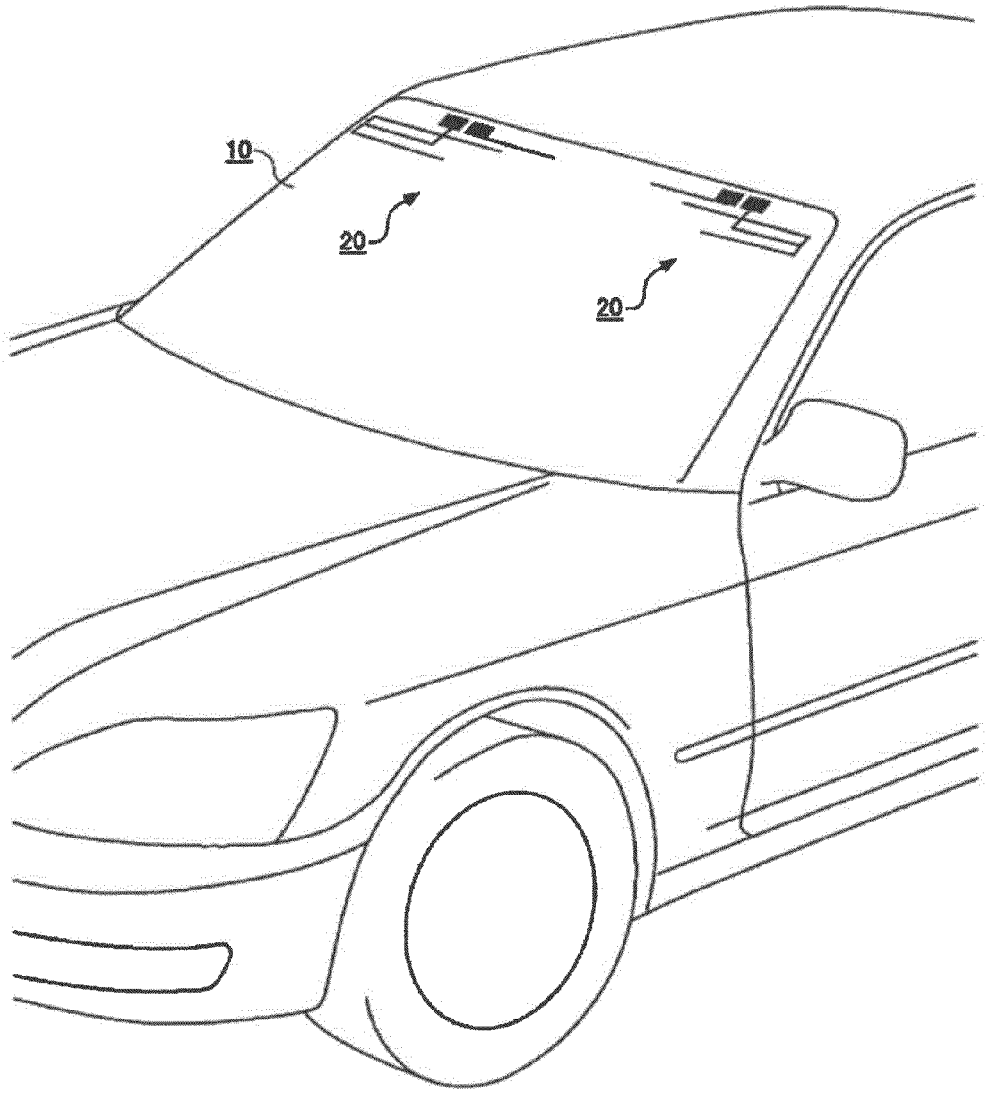
FIG. 1 is a perspective view showing an application example wherein an antenna-embedded laminated glass according to the present invention is applied as the front windshield of an automobile.

FIG. 1 shows an application example of an antenna-embedded laminated glass according to the present invention. Although the antenna-embedded laminated glass 10 is normally used as the front windshield of an automobile as in this application example, the laminated glass may be used as a side windshield or the rear windshield of an automobile.

Figure 8:
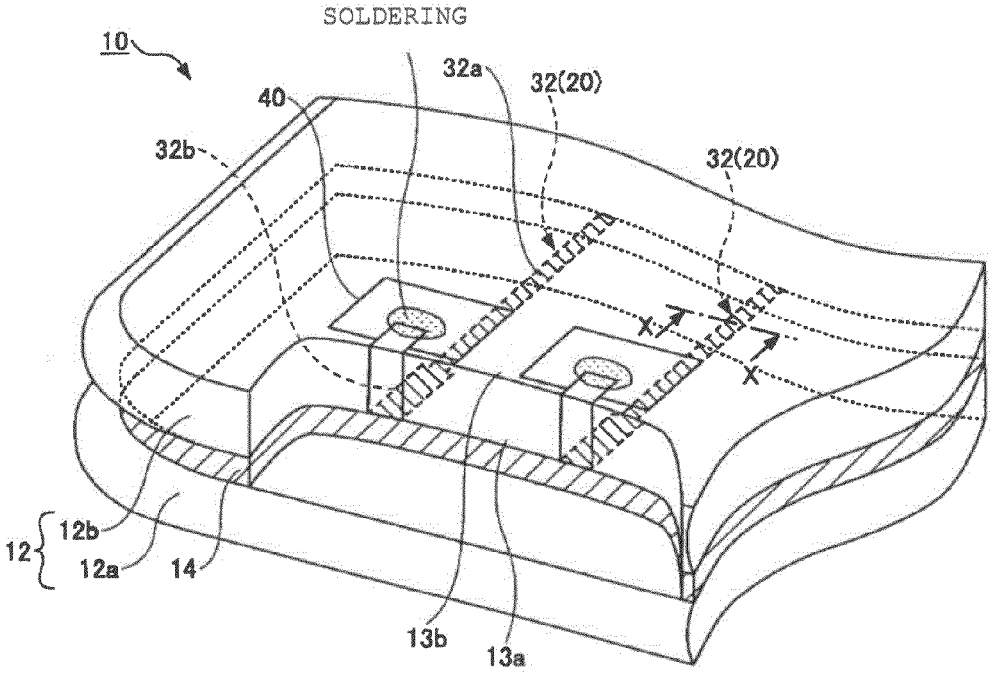
FIG. 8 is a perspective view showing a first embodiment of the electrode lead-out structure of the antenna element in an antenna-embedded laminated glass produced by the present invention.

The laminated glass 10 is produced by press-bonding a plurality of glass sheets 12 with an intermediate film 14 interposed therebetween (see FIG. 8). The intermediate film 14 may be made of, e.g., polyvinyl butyral (PVB).

Glass sheets 12 forming the laminated glass 10 have an antenna element 20 sealed therebetween as stated later. The antenna element 20 may be formed in a desired pattern as shown in FIG. 1 and receive, e.g., an electromagnetic wave from a television station or a radio station, an electromagnetic wave from a cell-phone, or an electromagnetic wave from a satellite. The present invention is well suited to a case where the desired pattern has such a shape as to have an intersection where a plurality of antenna-forming strips intersect. In this application example, the antenna element 20 is protected by the glass sheets 12 since the antenna element 20 is sealed between the glass sheets 12.

Figure 2:
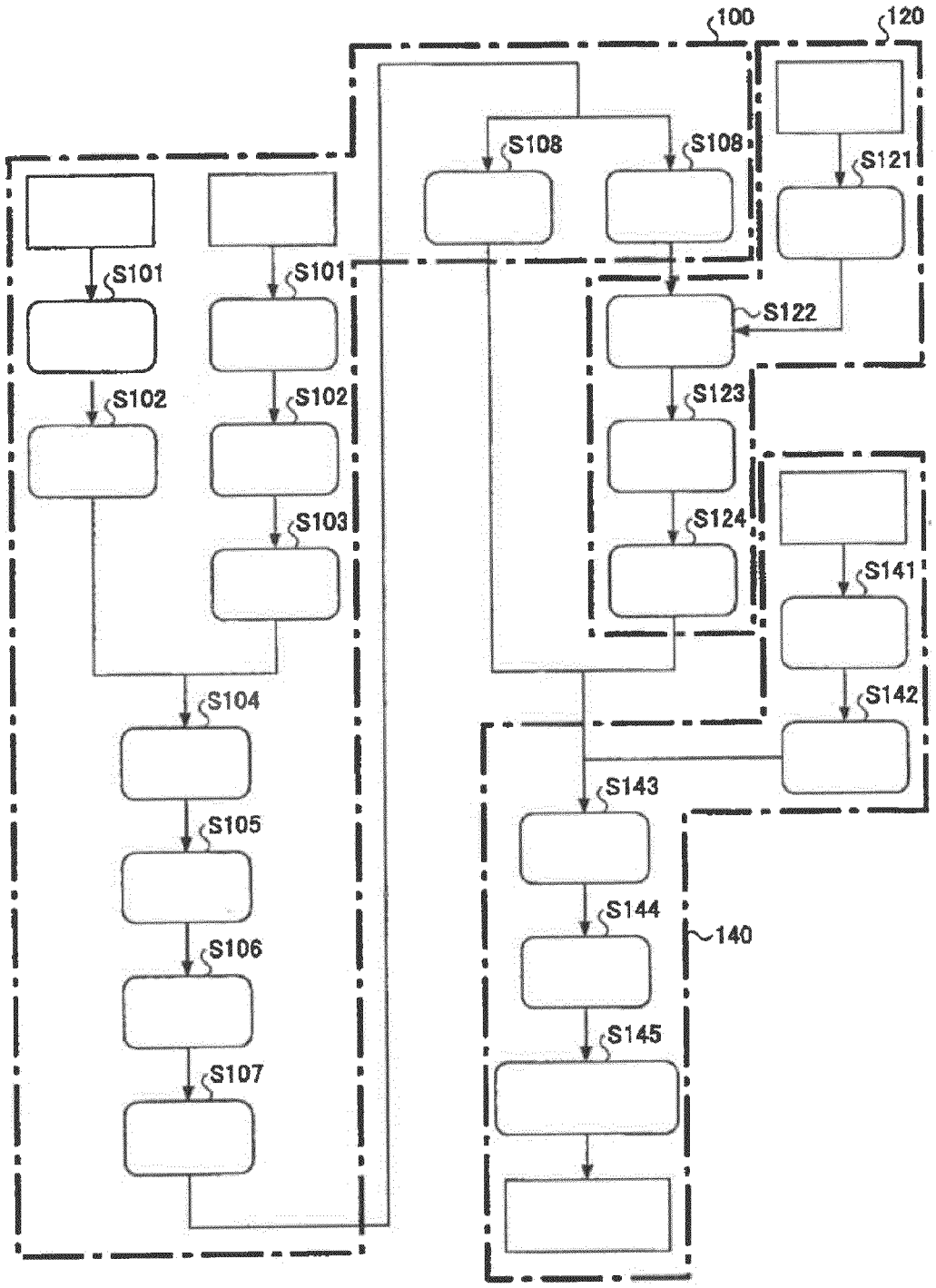
FIG. 2 is a flow sheet showing essential portions of a process for producing an antenna-embedded laminated glass according to the present invention.

FIG. 2 is a flow sheet showing essential portions of a process for producing an antenna-embedded laminated glass according to the present invention. Now, explanation will be made about a case wherein the laminated glass 20 comprises two glass sheets 12, and wherein the glass sheet that is located on an exterior side when the laminated glass is mounted to a vehicle is indicated by reference numeral 12*a*, and the glass that is located on an interior side is indicated by reference numeral 12*b*.

As shown in FIG. 2, the process for producing a laminated glass according to this embodiment comprises a glass sheets forming process 100, a conductive strip transferring process 120 and a glass sheets laminating process 140.

In the glass sheets forming process 100, two basic glass sheets are independently subjected to cutting and chamfering steps (Step 101), and cleaning and drying steps (Step 102). In order to conceal an eyesore, a print is applied to an edge portion of the basic glass sheet (interior glass sheet) that forms the glass sheet 12*b* on the interior side of the two basic glass sheets (Step 103). The print may be applied to an edge portion of the exterior glass sheet 12*a* or may be applied to each of the exterior glass sheet and the interior glass sheet. After that, both glass sheets are overlapped with each other (Step 104), and both glass sheets have edge portions carried on a frame, being overlapped each other. Next, the glass sheets thus overlapped are heated to a temperature of not lower than the softening point and are bent in a curved shape by gravity (Step 105). Then, both sheets are subjected to annealing (Step 106), and both sheets are separated from each other (Step 107). Thus, the glass sheets 12*a* and 12*b* are provided with surfaces having substantially the same curvatures as each other. The glass sheets 12*a* and 12*b* are subsequently and independently subjected to washing and drying steps (Step 108) and are transferred into the conductive strip transferring process 120.

In the conductive strip transferring process 120, an antenna sheet 30 is affixed on an exterior surface of the glass sheet 12*b*. The exterior surface of the glass sheet 12*b* is an exterior surface of the interior glass sheet 12*b* as stated earlier, that is to say, a surface of the glass sheet 12*b* confronting the glass sheet 12*a* when being laminated with the glass sheet 12*b* (hereinbelow, referred to as "the mating surface 13*a*").

Figure 3:
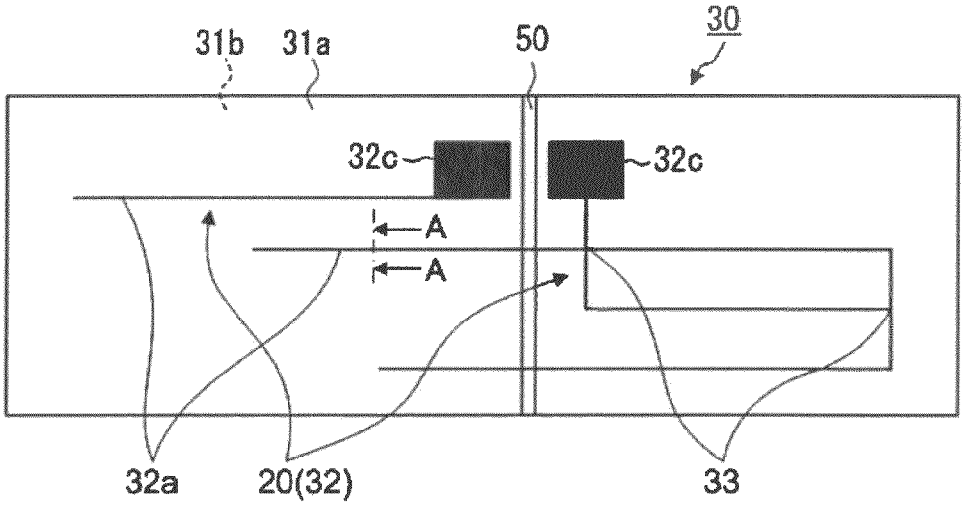
FIG. 3 is a schematic view showing the antenna sheet according to an embodiment of the present invention.
Figure 4:
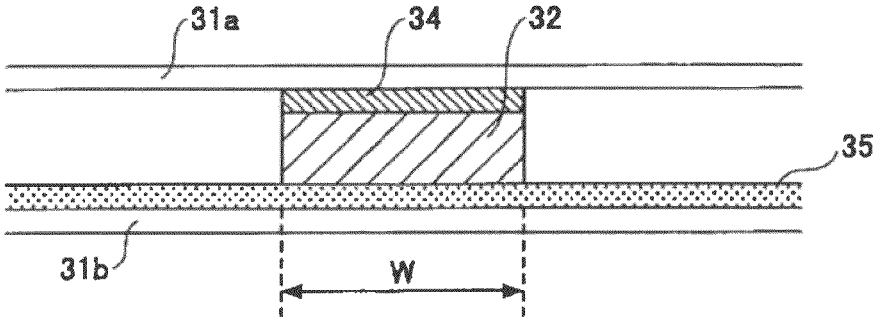
FIG. 4 is a cross-sectional view taken along line A-A of FIG. 3.

As shown in FIG. 3, the antenna sheet 30 is a sheet material having a desired shape. As shown in FIG. 4 (showing a cross-sectional view taken along line A-A of FIG. 3), the antenna sheet 30 comprises a transfer film material containing a conductive strip 32 for forming at least one antenna element 20 and a bonding strip 34. The conductive strip 32 and the bonding strip 34 are disposed between a first detachable layer (mount) 31*a* formed in the desired shape and a second detachable layer (protective film) 31*b*. The first detachable layer 31*a* is a mount, which serves to hold the antenna pattern formed by the conductive strip 32 until the conductive strip 32 is fixed to the mating surface 13*a* of the glass sheet 12*b*. Since the transfer film material includes the mount, it is possible not only to handle and fix the conductive strip but also to prevent the antenna pattern from being deformed. The second detachable layer 31*b* is a protective film, which serves to protect the conductive strip until the conductive strip 32 is fixed to the mating surface 13*a* of the glass sheet 12*b* through the bonding strip 34. Since the transfer film material includes the protective film, it is possible to prevent the antenna pattern from being deformed or broken by an external force. From this viewpoint, it is preferred that the second detachable layer 31*b* be detached immediately before the intermediate film is laminated on the mating surface 13*b*. The conductive strip 32 and the second detachable layer 31*b* have an adhesive layer 35 interposed therebetween. The adhesive layer 35 bonds the conductive strip 32 to the second detachable layer 31*b* by an easily-detachable adhesive force. The first detachable layer 31*a* may have a slit 50 formed in each certain region in consideration of workability in detaching operation.

Figure 5A:
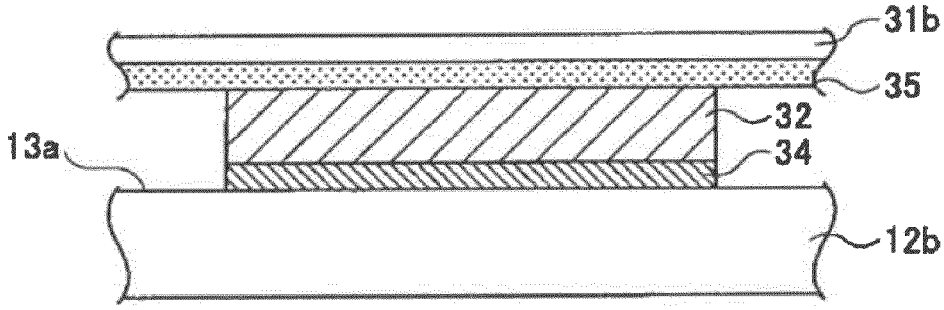
FIGS. 5A and 5B are schematic views explaining a conductive strip transferring process.

In the conductive strip transferring process 120, the first detachable layer (mount) 31*a* is first detached from the antenna sheet 30 (Step 121), and the antenna sheet 30 with the first detachable layer detached therefrom is located at and bonded to a desired position on the mating surface 13*a* of the glass sheet 12*b* (Step 122). At that time, the conductive strip 32 is bonded to the mating surface 13*a* of the glass sheet 12*b* by the bonding strip 34 as shown in FIG. 5A. In order to ensure that the bonding strip 34 and the mating surface 13*a* are bonded together, the antenna sheet 30 may be pressed against the mating surface 13*a* of the glass sheet 12*b*.

Figure 5B:
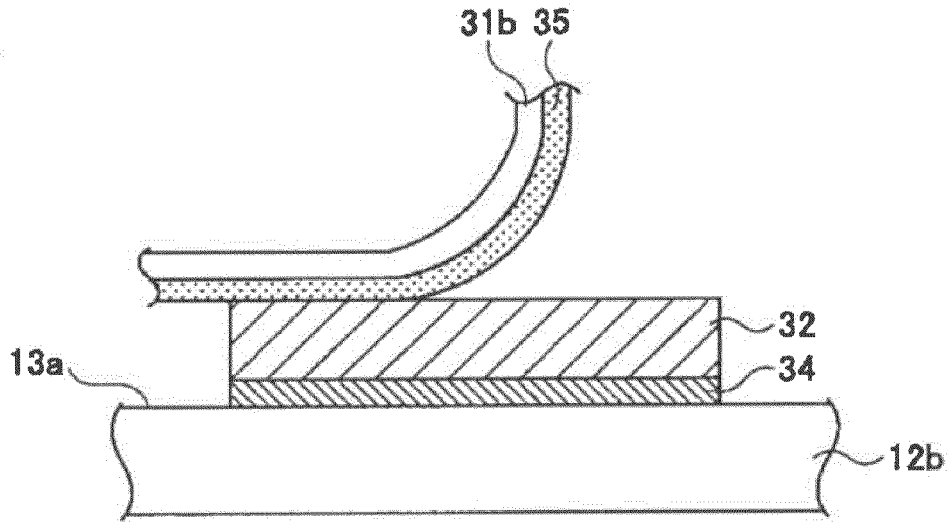

Next, the second detachable layer (protective film) 31*b* is detached along with the adhesive layer 35 from the conductive strip 32 as shown in FIG. 5B (Step 123). Thus, the first detachable layer 31*a* and the second detachable layer 31*b* are removed, and only the conductive strip 32 and the bonding strip 34 remain on the mating surface 13*a* of the glass sheet 12*b*. It is clear that the adhesive force between the adhesive layer 35 and the conductive strip 32 is adjusted to be sufficiently smaller than the bonding force of the bonding strip 34. The adhesive force thus adjusted is set to have a degree to prevent the conductive strip 32 from being detached along with the bonding strip 34 from the mating surface 13*a* of the glass sheet 12*b* or the conductive strip 32 from being detached from the bonding strip 34 when detaching the second detachable layer 31*b*.

After that, as required, treatment, such as bending an end portion of the antenna element 20 from an edge portion of the glass sheet 12*b* (see FIG. 8), may be performed for connection of the antenna element 20 (conductive strip 32) to an electrode 40 (see FIG. 8) (Step 124).

When the process 120 for bonding the antenna sheet to the glass sheet 12*b* is completed as stated earlier, the process proceeds to the glass sheets laminating process 140 to laminate the glass sheet 12*b* and the glass sheet 12*a*.

In the glass sheets laminating process 140, the glass sheets, the antenna element and the intermediate film for affixing the antenna element and the glass sheets are formed into a laminated structure, interposing the intermediate film between the glass sheets, and the glass sheets, the antenna element and the intermediate film are press-bonded to obtain a laminated glass. Specifically, the intermediate film 14 is first cut out into substantially the same shape as the glass sheets 12*a* and 12*b*, being subjected to a washing step and a film cutting step (Steps 141 and 142), and the intermediate film thus cut out is interposed into between the glass sheet 12*a* and 12*b* (Step 143). Thus, the intermediate film 14 is interposed between the mating surface 13*a* of the glass sheet 12*b* with the above-mentioned conductive strip 32 bonded thereto and the mating surface of the glass sheet 12*a*, providing the laminated structure. Next, both glass sheets 12*a* and 12*b* are preliminarily press-bonded (Step 144), and both glass sheets are primarily press-bonded together by an autoclave (pressure vessel) (Step 145). As a result, the bonding surfaces between the intermediate film 14 and each of both glass sheets 12*a* and 12*b* are completely evacuated and melt-bonded, and thus the laminated glass 10 is completed.

Additionally speaking, the antenna sheet 30 (the conductive strip 32) is bonded to the mating surface 13*a* of the glass sheet 12*b*, which is a convex side, in this embodiment. In this embodiment, a tension is placed on the antenna sheet 30 at the time of affixture as opposed to a case where the antenna sheet 30 is affixed to a concave side (for example, the interior surface of the glass sheet 12*a*). Accordingly, the antenna sheet 30 is unlikely to be wrinkled, providing good workability. Additionally, the weather resistance of the antenna element 20 is improved since the conductive strip 32 is located on a position closer to the interior of the vehicle than the intermediate film 14 having a UV cutting function.

Although the conductive strip transferring process 120 may be manually performed by an operator in this embodiment, this process may be automated, using, e.g., a robot. The antenna sheet 30 does not always need to be delivered, being separated from other antenna sheets. As another delivery mode, plural antenna sheets 30, which are separable from each other, are continuously wound on a roll, and the respective antenna sheets may be separated from each other, being unwound from the roll on the production line.

The glass sheets forming process stated earlier is an example. The glass sheets may be bent by being pressed by a convex mold from above, instead of being bent in a curved shape by gravity while being carried on a frame.

Although explanation has been made about a case where the antenna sheet is affixed to the glass sheets, the present invention is not limited to such a case. The antenna sheet may be affixed to the intermediate film after the intermediate film has been laminated on a glass sheet. Or, the intermediate film may be laminated to the glass sheets, having the antenna sheet pre-affixed thereto.

Figure 6A:
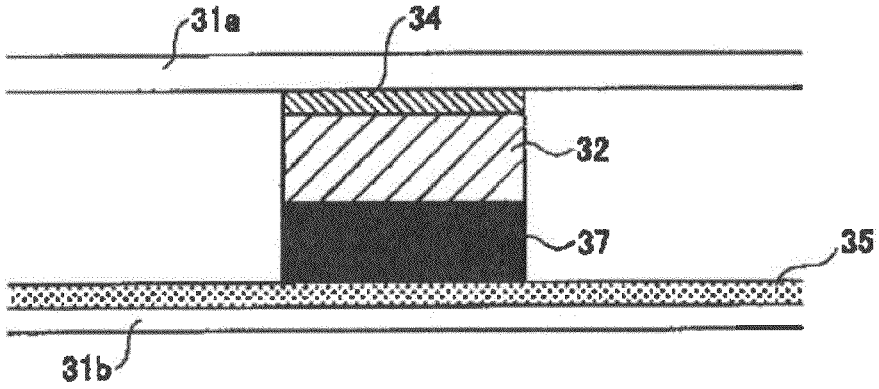
FIGS. 6A and 6B are a cross-sectional view taken along line A-A of FIG. 3, showing the antenna sheet according to another embodiment, and a cross-sectional view taken along line A-A of FIG. 3, showing the antenna sheet according to another embodiment, respectively.
Figure 6B:
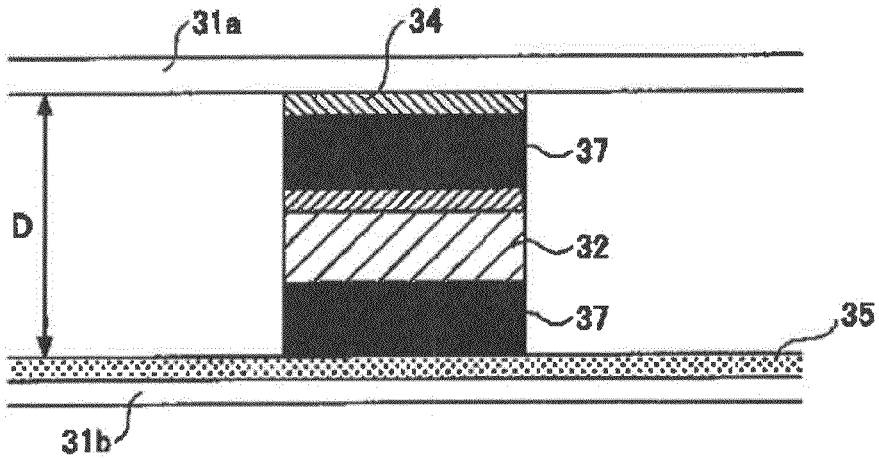

FIGS. 6A and 6B show other embodiments of the antenna sheet 30, which are different from the embodiment shown in FIG. 4, and these figures correspond to the cross-sectional view taken along line A-A of FIG. 3.

The antenna sheets 30 shown in FIG. 6A includes a dark strip 37 laminated on a side of the conductive strip 32 opposite from the bonding strip 34. The dark strip 37 comprises a black paint having a low reflectance and is disposed by being applied on the conductive strip 32. The dark strip may be disposed by printing or the like. The conductive strip 32 is disposed so as not to be noticeable from outside in terms of good appearance. In some cases, the glass sheet 12*b* on the interior side has a light-shielding film (dark ceramic paste) disposed on an interior-side surface thereof in a region where the antenna sheet is affixed, taking into account that the conductive strip is noticeable when seeing this region from outside. The dark strip 37 also functions to protect the conductive strip 32 to increase the strength and the stability of the conductive strip. The antenna sheet 30 shown in FIG. 6B includes dark strips 37 disposed both sides of the conductive strip 32. By disposing such dark strips on both sides of the conductive strip, it is possible to make the conductive strip 32 unnoticeable from the interior side as well. In the example shown in FIG. 6B, the dark strip 37 disposed on the interior side is formed as a sheet and is laminated on the conductive strip 32 through a bonding strip. However, the present invention is not limited to this mode. The dark strip 37 disposed on the interior side may be disposed by applying or printing a black paint on the conductive strip 32. Likewise, the dark strip 37 disposed on the exterior side may also be formed as a sheet and be laminated on the conductive strip 32 through a bonding strip. When the dark strip is disposed only on a single side, in order that the dark strip is located at a position closer to the exterior side than the conductive strip 32, the dark strip is disposed on either one of sides of the conductive strip 32, depending on to which side of a glass sheet or an intermediate film the conductive strip is affixed. As explained, the antenna sheet 30 may appropriately include various kinds of layers in addition to the conductive strip 32 and the bonding strip 34. The thickness of each of the strips and the layers may be appropriately set. For example, the transfer film material shown in FIG. 6B may have a total thickness D of about 0.3 mm. These figures show embodiments wherein a dark strip or dark strips using a black paint are applied by printing for concealing an eyesore. However, the color of the dark strip or the dark strips is not limited to black. Any other colors, such as gray or dark brown, are acceptable as long as a selected color can shield visual light.

The conductive strip 32 may be made of soft copper. The bonding strip 34 or the adhesive layer 35 may be made of an acrylic adhesive material. The second detachable layer may be made of a polyester film. The first detachable layer 31*a* may be made of woodfree paper having a single side poly-laminated or a resin sheet (such as a PET sheet), which is treated so as to have a detachable property.

Figure 7:
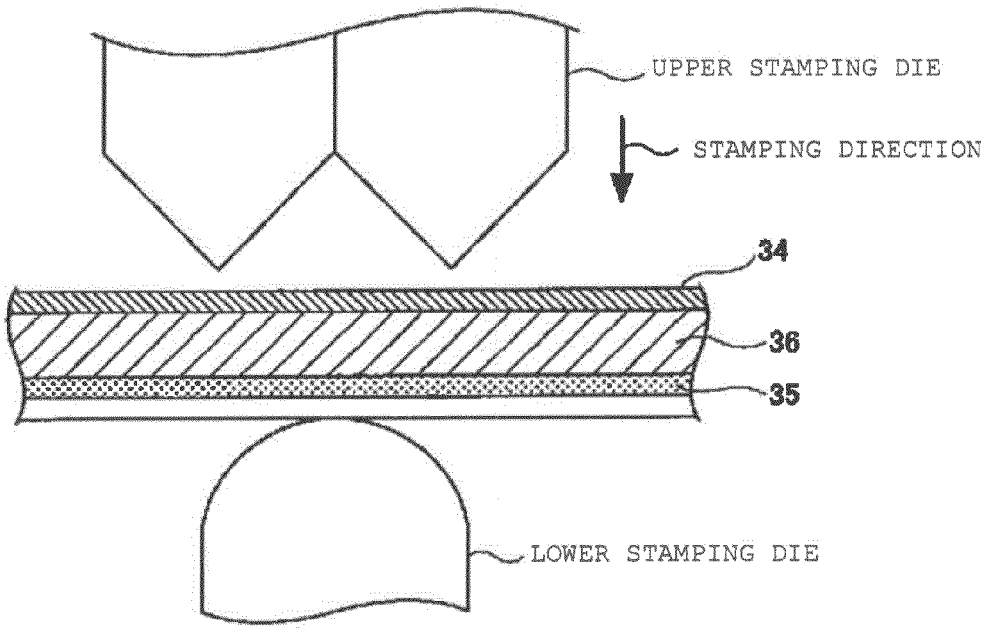
FIG. 7 is a schematic view showing how laminated sheets are stamped out when producing the antenna sheet shown in FIG. 3 and FIG. 4.

FIG. 7 shows how the transfer film material is stamped when preparing the antenna sheet 30 shown in FIG. 4. A sheet, which is formed of the second detachable layer 31*b*, and the adhesive layer 35, a sheet-like conductor 36 and the bonding strip 34 laminated on the second detachable layer, is prepared. As shown in FIG. 7, the sheet-like conductor 36 is stamped by a press, being interposed between an upper stamping die and a lower stamping die, each of which is formed in a desired shape. Since the lower stamping die has a tip formed in a curved shape so as to face two blades forming the upper stamping die, the stamping operation proceeds up to the conductive strip 32 so as to form a desired shape, keeping the second detachable layer 31*b* and the adhesive layer 35 unstamped.

In the conventional intermediate film embedded type with an antenna wire embedded in an intermediate film, when adopting a pattern which has intersections 33 where antenna-forming strips intersect in a T-character shape or a cross shape as shown in FIG. 3, the antenna-forming strips overlap and bank up at the intersections 33. If the glass sheets 12*a* and 12*b*, and the intermediate film 14 are laminated and press-bonded in such a state, gaps are formed at the intersections 33.

On the other hand, in this embodiment, even when adopting a pattern which has intersections 33 where antenna-forming strips intersect in a T-character shape or a cross shape as shown in FIG. 3, it is possible to form the conductive strip 33 so as to have a certain line width W and a certain uniform thickness since the antenna elements 20 are formed by stamping the sheet-like conductor 36.

The line width W of the conductive strip 32 satisfies the formula of $0.15 \leqq W \leqq 0.4$ mm, preferably the formula of $0.2 \leqq W \leqq 0.3$ mm, in an antenna pattern portion as a portion excluding edge portions, an electrode portion or the like. This arrangement can provide the laminated glass with a good appearance and is advantageous from the viewpoint that the antenna element is prevented from obstructing a driver's view when the laminated glass is used as an automobile windshield. Explanation of this embodiment has been made about a case wherein the conductive strip 32 is formed by stamping a transfer film material. The bonding strip may be formed on a surface of the conductive strip after forming the pattern by the conductive strip.

It should be noted that after stamping, a portion of the conductive strip other than the patterned portion is removed, that the second detachable layer 31*b* is combined with the first detachable layer 31*a* with the stamped conductive strip 32 and bonding strip 34 being interposed therebetween through the adhesive layer 35, and that the combination is passed between rollers to complete the antenna sheet 30.

FIG. 8 is a perspective view of a first embodiment of the electrode lead-out structure of the antenna element 20 in an antenna-embedded laminated glass 10 produced according to the above-mentioned embodiments.

This embodiment is related to an antenna-embedded laminated glass 10, which is produced by using the antenna sheet 30 shown in FIG. 3. In this embodiment, the electrode lead-out portion of each of the antenna elements 20 is formed from a portion of the conductive strip 32 having a relatively large line width W. In other words, the conductive strips 32 in this embodiment are stamped so that each of the conductive strips comprises a thin linear portion 32*a* having a line width W satisfying the equation of $0.15 \leqq W \leqq 0.4$ mm and an extension 32*b* made of the same material as the thin linear portion and having a relatively larger line width and a length.

Figure 9:
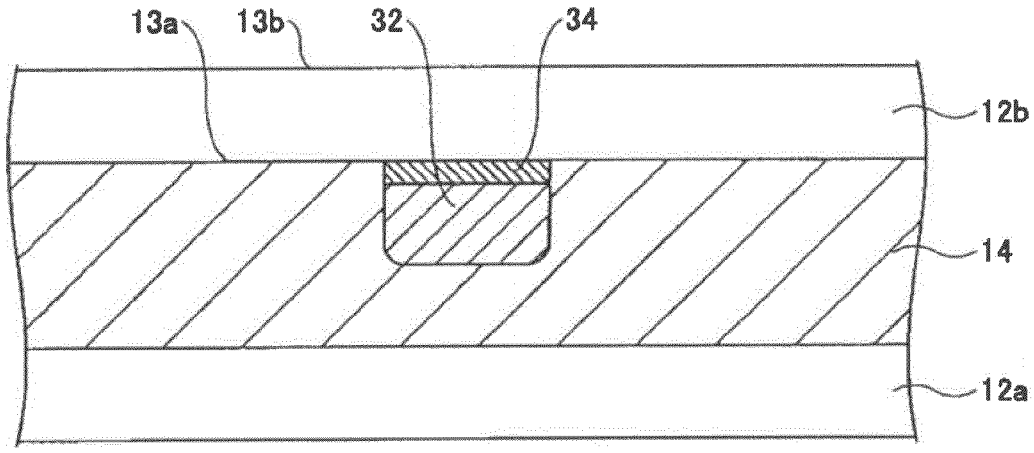
FIG. 9 is a cross-sectional view taken along line X-X of FIG. 8.

FIG. 9 is a cross-sectional view taken along line X-X of FIG. 8. The thin linear portion 32*a* and a portion of the extension 32*b* are bonded to the mating surface 13*a* of the glass sheet 12*b* by the bonding strip 34 as stated earlier. As seen from FIG. 9, the conductive strip 32 bonded to the glass sheet 12*b* by the bonding strip 34 is embedded in the intermediate film 14 after the primary press-bonding process is completed.

The extension 32*b* is folded at an edge portion of the glass sheet 12*b* toward an opposite surface 13*b* of the glass sheet 12*b*. This folding step is performed by folding a leading portion of the antenna sheet 30 toward the opposite surface 13*b* of the glass sheet 12*b* along a folding line H as shown in FIG. 3 and affixing an end portion of the antenna sheet to the opposite surface in the conductive strip transferring process 120.

An end of the extension 32*b* is connected to an electrode 40, which is formed on the opposite surface 13*b* of the glass sheet 12 by, e.g., printing. The connection between the edge of the extension 32*b* and the electrode 40 is made by soldering after the above-mentioned primary press-bonding treatment (Step 145) has been completed.

The electrode 40 is connected to an amplifier (not shown) through a wire (not shown), the amplifier being disposed on a vehicle side for amplifying an electromagnetic wave received by the antenna element 20. When the antenna is activated, an electromagnetic wave received by the antenna element 20 is taken out through the electrode 40, is subjected to processing (such as amplification) as required and is supplied to an in-vehicle media system, such as a TV receiver. The electromagnetic wave received by the antenna element 20 may be wirelessly transmitted an in-vehicle media system through a Bluetooth receiver or a wireless LAN receiver connected the electrode 40.

Figure 10:
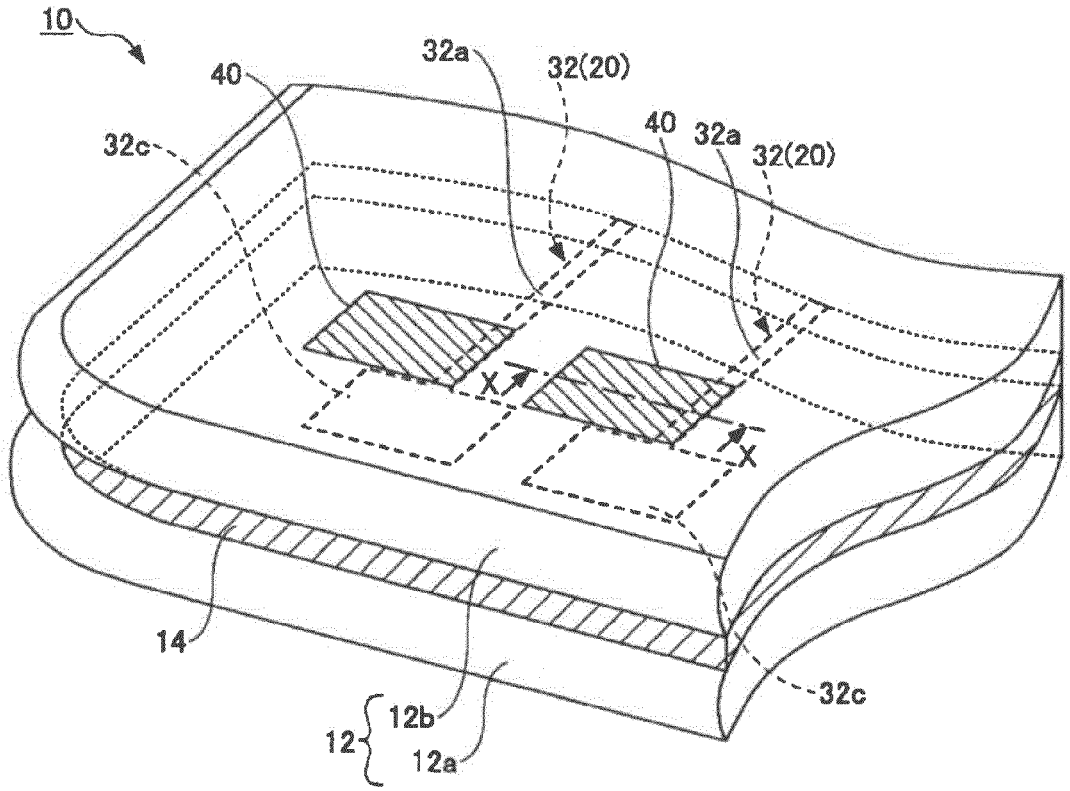
FIG. 10 is a perspective view showing a second embodiment of the electrode lead-out structure of the antenna element in an antenna-embedded laminated glass produced by the present invention.

FIG. 10 is a perspective view showing a second embodiment of the electrode lead-out structure of the antenna element 20 in an antenna-embedded laminated glass 10 produced according to the above-mentioned embodiment.

Figure 11:
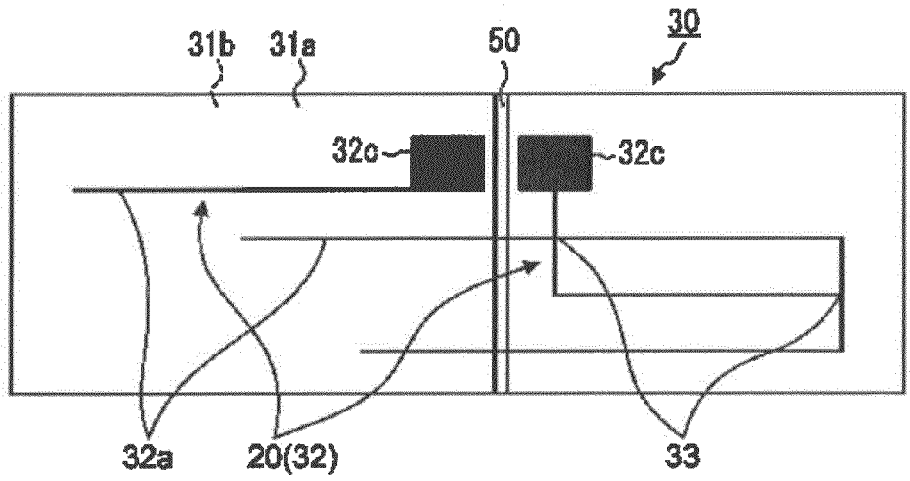
FIG. 11 is a schematic view showing the antenna sheet corresponding to the embodiment shown in FIG. 10.

In this embodiment, each of the antenna elements 20 has an electrode per se comprising a portion of the conductive strip 32 formed in a desired shape. In other words, the conductive strips 32 in this embodiment are stamped so that each of the conductive strips comprises a thin linear portion 32*a* having a constant line width W satisfying the formula of $0.15 \leqq W \leqq 0.4$ mm and an electrode 32*c* having a region formed in a desired shape. FIG. 11 shows the antenna sheet 30 corresponding to this embodiment.

Figure 12:
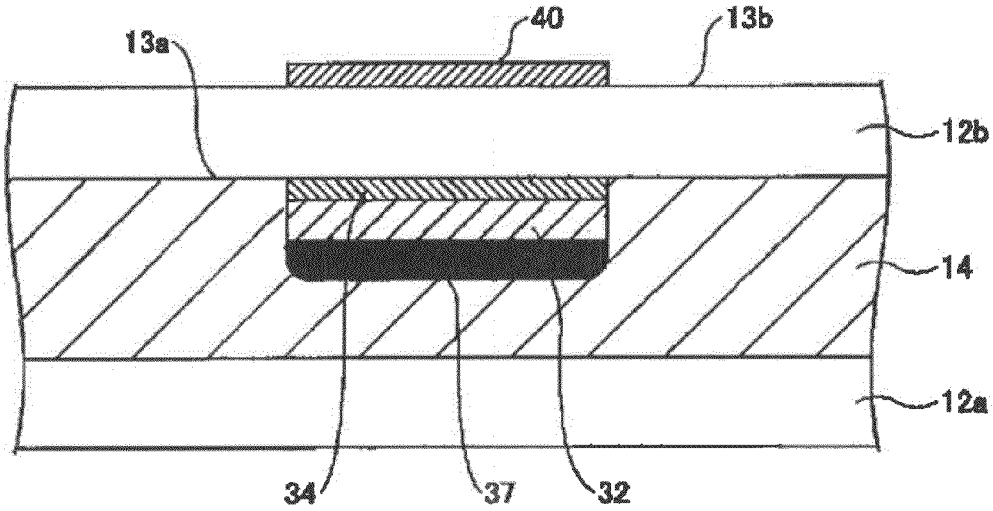
FIG. 12 is a cross-sectional view taken along line X-X of FIG. 10.

FIG. 12 is a cross-sectional view taken along line X-X of FIG. 10. The thin linear portion 32*a* and the electrode 32*c* are bonded to the mating surface 13*a* of the glass sheet 12*b* by the bonding strip 34 as stated earlier. In the embodiment shown in FIG. 12, an antenna sheet 30 having a laminated structure as shown in FIG. 6A as stated earlier is used. Thus, the electrode 32*c* is sealed as the conductive strip 32 between both glass sheets 12*a* and 12*b* of a laminated glass 10.

The opposite surface 13*b* of the glass sheet 12*b*, which is to be located at the most interior side among the glass sheets forming the laminated glass 10, has an electrode 40 disposed at a position to confront the electrode 32*c* by, e.g., printing. The electrode 40 may be formed by affixing copper foil having a bonding strip. Thus, the electrode 40 and its corresponding electrode 32*c* can be connected through static capacitive coupling (electromagnetic coupling). The electrode 40 is connected to an in-vehicle amplifier (not shown) through a wire (not shown), the amplifier serving as amplifying an electromagnetic wave received by the antenna element 20. When the antenna is activated, an electromagnetic wave received by the antenna element 20 is taken out through the static capacitive coupling between the electrode 40 and the electrode 32, is subjected to processing (such as amplification) as required and is supplied to an in-vehicle media system, such as a TV receiver, through an external wire (not shown). An electromagnetic wave received by the antenna element 20 may be wirelessly transmitted to an in-vehicle media system through a Bluetooth receiver or a wireless LAN receiver connected to the electrodes 40.

In this embodiment, it is not necessary to connect each of the electrodes 40 and the antenna element 20 on the laminated glass 10 by soldering, and it is possible to connect an in-vehicle media system and the antenna element 20 through static capacitive coupling. Accordingly, it is possible to avoid inconvenience that a heat stress is generated in the glass sheets 12*a* and 12*b* because of heat generated during soldering.

Although preferred embodiments of the present invention have been described in detail, the present invention is not limited to the above-mentioned embodiments. It is to be understood that various modifications or changes are applicable to the above-mentioned embodiments without departing from the sprit and the scope of the present invention.

Although the above-mentioned embodiments have been described in a case wherein the antenna sheet 30 is disposed between the intermediate film 14 and the mating surface 13*a* of the interior glass sheet 12*b*, it is to be understood that the present invention does not exclude a structure wherein the antenna sheet 30 is disposed between the intermediate film 14 and the exterior glass sheet 12*a*.

The intermediate film 14 cannot always comprise a single layer. The intermediate film may comprise plural layers between the two glass sheets 12. The intermediate film 14 may have another function, such as a sound isolation function or heat reflection function.

What is claimed is:

1. An antenna-embedded laminated glass comprising a plurality of glass sheets affixed together through an intermediate film to embed an antenna element between adjacent glass sheets of the plurality of glass sheets, the intermediate film comprising:

a resin; and an antenna element comprising a conductor strip stamped in a shape from a sheet-like conductor, the shape including an intersection portion where a plurality of antenna-forming strips of the conductor strip intersect each other, and a non-intersection portion where at least one of said plurality of antenna forming strips does not intersect another of said plurality of antenna-forming strips, wherein a cross-sectional thickness of the intersection portion is substantially the same as a cross-sectional thickness of the non-intersection portion.

2. The antenna-embedded laminated glass according to claim 1, wherein the conductor strip has a bonding strip laminated on a surface thereof, the bonding strip being affixed to a surface of at least one of the plurality of glass sheets that confronts the intermediate film.

3. The antenna-embedded laminated glass according to claim 2, wherein the bonding strip is affixed to a convex side of the at least one of the glass sheets that confronts the intermediate film.

4. The antenna-embedded laminated glass according to claim 3, wherein the conductive strip has a dark strip laminated on a surface of the conductive strip which is opposite from the surface of the conductor strip having the bonding strip laminated thereon.

5. The antenna-embedded laminated glass according to claim 3, wherein the conductive strip has a first dark strip disposed on the surface of the conductor strip having the bonding strip laminated thereon and a second dark strip disposed on a surface of the conductive strip which is opposite from the surface of the conductor strip having the bonding strip laminated thereon.

6. The antenna-embedded laminated glass according to claim 1, wherein the conductor strip has a bonding strip laminated on a surface thereof, and the bonding strip is affixed to a surface of the intermediate film.

7. The antenna-embedded laminated glass according to claim 6, wherein the conductive strip has a dark strip laminated on a surface of the conductive strip which is opposite from the surface of the conductor strip having the bonding strip laminated thereon.

8. The antenna-embedded laminated glass according to claim 1, further comprising an electrode for taking out a signal, disposed on an outermost glass sheet among the plurality of glass sheets wherein the antenna element being coupled to the electrode through static capacitive coupling.

9. The antenna-embedded laminated glass according to claim 1, wherein the conductive strip includes a linear portion formed in a desired pattern and having a line width (W) satisfying the formula of $0.15<W<0.4$ mm.

10. The antenna-embedded laminated glass according to claim 1, wherein the conductive strip includes a linear portion formed in a desired pattern and having a line width (W) satisfying the formula of $0.2<W<0.3$ mm.

11. The antenna-embedded laminated glass according to claim 1, wherein the conductive strip contains soft copper.

12. The antenna-embedded laminated glass according to claim 1, wherein the antenna element is configured to receive digital broadcasting.

13. The antenna-embedded laminated glass according to claim 1, wherein the antenna-embedded laminated glass is configured to be used as a windshield for a vehicle.

* * * * *